US005680879A

United States Patent [19]

Sheih et al.

[11] Patent Number: 5,680,879

[45] Date of Patent: Oct. 28, 1997

[54] AUTOMATIC FLUSH VALVE ACTUATION APPARATUS FOR REPLACING MANUAL FLUSH HANDLES

[75] Inventors: Rocky Sheih, Hsin Chu, Taiwan; Kenneth J. Muderlak, Shorewood, Wis.

[73] Assignee: Technical Concepts, Inc., Elk Grove, Ill.

[21] Appl. No.: 706,429

[22] Filed: Sep. 5, 1996

Related U.S. Application Data

[63] Continuation of Ser. No. 304,746, Sep. 12, 1994, abandoned.

[51] Int. Cl.[6] ..... F16K 31/10

[52] U.S. Cl. ..... 137/240; 4/226.1; 4/DIG. 3; 251/129.04

[58] Field of Search ..... 137/240; 4/226.1, 4/DIG. 3; 251/129.04, 129.2

[56] References Cited

U.S. PATENT DOCUMENTS

| | | | |
|---|---|---|---|
| 1,057,632 | 4/1913 | Fraser | 4/226.1 X |
| 2,552,625 | 5/1951 | Filliung | 4/DIG. 3 |
| 2,635,691 | 4/1953 | Filliung | 4/DIG. 3 |
| 3,056,143 | 10/1962 | Foster . | |
| 4,309,781 | 1/1982 | Lissan | 4/DIG. 3 |
| 4,742,583 | 5/1988 | Yoshida et al. | 4/313 |
| 4,793,588 | 12/1988 | Laverty, Jr. | 251/30.03 |
| 4,805,247 | 2/1989 | Laverty, Jr. | 4/304 |
| 4,839,039 | 6/1989 | Parsons et al. | 210/143 |
| 4,886,207 | 12/1989 | Lee et al. | 251/129.04 X |
| 4,891,964 | 1/1990 | Laverty, Jr. | 91/399 |
| 4,911,401 | 3/1990 | Holcomb et al. | 251/30.03 |
| 4,971,287 | 11/1990 | Shaw | 251/30.05 |
| 4,972,070 | 11/1990 | Laverty, Jr. | 250/221 |
| 4,989,277 | 2/1991 | Tsutsui et al. | 4/367 |
| 5,025,516 | 6/1991 | Wilson | 4/623 |
| 5,062,453 | 11/1991 | Saadi et al. | 251/129.04 X |
| 5,063,955 | 11/1991 | Sakakibara | 137/1 |
| 5,125,621 | 6/1992 | Parsons et al. | 251/30.03 |
| 5,155,870 | 10/1992 | Tsutsui et al. | 4/300 |
| 5,169,118 | 12/1992 | Whiteside | 251/30.03 |
| 5,187,818 | 2/1993 | Barrett, Sr. et al. | 4/313 |
| 5,195,720 | 3/1993 | Nortier et al. | 251/120.04 |
| 5,244,179 | 9/1993 | Wilson | 251/30.03 |
| 5,269,028 | 12/1993 | Liao | 4/226.1 X |
| 5,431,181 | 7/1995 | Saadi et al. | 137/15 |

FOREIGN PATENT DOCUMENTS

| | | | |
|---|---|---|---|
| 0338825 | 10/1989 | European Pat. Off. | 4/226.1 |

*Primary Examiner*—Stephen M. Hepperle
*Attorney, Agent, or Firm*—Sonnenschein, Nath & Rosenthal

[57] ABSTRACT

An automatic flush handle actuation apparatus is provided for replacing a manually-activated flush handle of a flush mechanism of a sanitary facility. The apparatus includes an enclosure containing a drive mechanism and a self-contained power source for the drive mechanism. The apparatus also includes means for sensing use of the sanitary facility and means for interconnecting the drive mechanism and power source when the means for sensing detects a use of the sanitary facility. An adaption having first and second ends is included rigidly engaging the enclosure at the first end and a plunger pin having first and second ends slidably extending through the adapted, engaging the drive mechanism within the enclosure of a first end. A threaded nut is provided around the adapter captured on the adapter at a first end by the enclosure and by a hub at the second end of the adapter, the threaded nut, second end of the adapter and a second end of the plunger pin being constructed to operably interact with the flush mechanism in a manner substantially identical to a nut, adapter and plunger pin of the manually-activated flush handle.

27 Claims, 7 Drawing Sheets

100Ω
150K
150K
100K
100K
47μ
4.7K
A
1M
47μ
102
100K
D6
104
Q1
Q2
Q3
222
223
224
225
D7
D8
104
470K
10K
100K
10K
D1
100
10K
104
100K
VR1
47μ
IC1
226
227
210
IC2
212
212
DQ
IC3
Q̄
207
IC4
S2
206
R1
470K
4.7K
330Ω
Q5
104
C3
C2
104
150K
R3
D10
IC2
209
IC5
204
203
IC5
201
IC4
Q4
IC5
IC2
IC5
IC4
10K
56
M
IC2
R4
S1
208
150K
R10
205
4.7μ
C1
R2
150K
D9
211
B
D2
10Ω
D12
D3
10Ω
100μ
10K
C7
102
IC2
IC2
Q6
DQ
R7
4.7K
IC8
221
D13
100K
R8
D14
150K
R6

104
C6
S3
216
DQ
IC8
Q̄
A
3
6
1K
D4
1
14
215
IC7
218
IC5
150K
IC9
13
IC7
IC6
IC6
220
7
11
213
217
214
IC7
B
IC6
6.0V
228
IC4
D15
216
100Ω
4
150K
5
200
R5
C5
100P
104
D5
3.3V
IC11
100μ
100μ
IC10
470μ
100μ

AUTOMATIC FLUSH VALVE ACTUATION APPARATUS FOR REPLACING MANUAL FLUSH HANDLES

This is a continuation of application Ser. No. 08/304,746, filed Sep. 12, 1994, now abandoned.

FIELD OF THE INVENTION

The present invention relates to automatic flush valve actuation devices for toilet and urinal facilities, and in particular to substitute flush valve actuation devices that are adapted to be readily and easily attached to existing flush valve mechanisms.

BACKGROUND OF THE INVENTION

Public awareness of personal hygiene and water conservation issues over the last several years has initiated a response by manufacturers of public and private sanitary and water use facilities to develop systems that eliminate human contact with environmental surfaces that may contain disease spreading bacteria and to control flush water usage to eliminate waste.

Many present toilet and urinal flush devices for sanitary facilities are operated by a water control valve including a manually operable flush handle adapted to be gripped and moved by a user following use of the sanitary facility. A typical valve arrangement is shown, by way of example, in U.S. Pat. Nos. 2,776,812 and 3,399,860. However, those valve actuation devices present several problems. Among these problems are the fact that with an enlightened awareness that public sanitary facilities may have been previously used by someone having a communicable or other disease that is spread upon contact, individual users of the sanitary facility are becoming reluctant to touch the flush handle and risk becoming ill. Therefore, the sanitary facility may remain unflushed, leaving human waste products in the toilet and urinal, obviously increasing the unsanitary conditions, and fouling the atmosphere in the facility. Therefore, having flush mechanisms that people won't use can lead to extremely unsanitary and undesirable conditions.

In addition, many present flush handle operated valve mechanisms for sanitary devices are constructed such that the user can hold on to the handle for an excessive time period, retaining the valve mechanism in an open position longer than necessary to flush the toilet or urinal. This obviously wastes water, which can be a major problem in those parts of the world where water is increasingly becoming a scarce commodity. Also, excessive water use leads to additional and unnecessary costs for the entity installing and maintaining the washroom facility.

Several systems have been developed in an attempt to address the hygiene and water control problems of existing manual flush control mechanisms for sanitary facilities. These include structures which totally replace the manually operated flush valve mechanism with an automatic, sensor actuated flush valve operation device that is also connected to the 110 volt electrical system extant in the facility. Such a system is shown in U.S. Pat. No. 4,793,88. However, the replacement of existing manually operated flush handle devices with such units is very costly, particularly in buildings such as hotels, office buildings and the like which presently have installed numerous manually operated flush mechanisms in their sanitary facilities. Such replacement would require the work of mechanical and plumbing personnel, and the installation cost of replacing numerous manually operable flush devices with automatic devices of the type disclosed in U.S. Pat. No. 4,793,588 would be prohibitive. Also, this replacement project would require a shut down of the water supply system of turning off water to the valve until the valve mechanisms could be replaced, which is undesirable in large hotel, office, and other structures. Additionally, building permits would be required for such a replacement project.

Another attempt to automatically operate a manual flush valve mechanism for a sanitary facility is shown in U.S. Pat. No. 3,056,143, which discloses a door operated electrical solenoid device for depressing a manual flush handle each time the door to the toilet stall is opened. However, the device shown in U.S. Pat. No. 3,056,143 has many shortcomings. The existing valve housing in the prior art structure would have to be disassembled, re-worked and retrofitted to accept the bracket supporting the solenoid. This requires reconstruction of the valve housing. Also, the cantilever nature of the reference mounting structure will result in possible movement of the bracket upon actuation of the solenoid, and improper actuation of the flush handle. Further, the reference device is tied to the electrical system of the building in which the stall is located, requiring added installation costs. The reference device will operate each time the door opens, whereby the flush mechanism will operate twice for each use. This waste could be significant, considering that sanitary facilities are operated 4,000 times per month in many installations. Additionally, in the reference device, the existing flush handle remains exposed, whereby the handle can be manually operated or kicked, as some users are prone to do to avoid touching the handle. This exposure of the handle can also lead to water waste through manual operation.

Therefore, it is an object of the present invention to provide an automatic flush valve actuation apparatus to be installed and mounted on existing flush valve mechanisms without requiring significant mechanical work or structural changes to the existing manual flush mechanism.

It is a further object of the present invention to provide an automatic flush valve actuation apparatus which can be readily mounted to existing flush valve mechanisms, whereby the flush valve actuation apparatus engages a portion of the flush mechanism housing to prevent disengagement of the actuation apparatus during operation.

Another object of the present invention is to provide a battery operated flush valve actuation device for a sanitary unit such as a toilet or urinal, which requires no connection to the extant electrical system of the installation in which the sanitary unit is located.

An additional object of the present invention is to provide an automatically operated actuation device for existing sanitary unit flush handle mechanisms which can be actuated by sensors responsive to use of the facility, and by timing devices that automatically actuate the flush handle at predetermined time intervals.

Yet another object of the present invention is to provide an automatically operated flush valve actuation device in a compact, self contained unit which can be readily attached to an existing flush valve mechanism on existing sanitary units without the need to connect the actuation device to any outside power or control sources.

SUMMARY OF THE INVENTION

These and other objects and advantages of the present invention are provided in an apparatus for automatically actuating the flushing mechanism of a sanitary device.

An automatic flush valve actuation apparatus is provided for replacing a manually activated flush handle of a flush mechanism of a sanitary facility. The apparatus includes an enclosure containing a drive mechanism and a self-contained power source for the drive mechanism. The apparatus also includes means for sensing use of the sanitary facility and means for interconnecting the drive mechanism and the power source when the means for sensing detects a use of the sanitary facility. An adapter is included having first and second ends rigidly engaging the enclosure at the first end and a plunger pin having first and second ends slidably extending through the adapter, engaging the drive mechanism within the enclosure at a first end. A threaded nut is provided around the adapter, captured on the adapter at a first-end by the enclosure and by a hub at the second end of the adapter, the threaded nut, second end of the adapter and second end of the plunger pin being constructed to operably interact with the flush mechanism in a manner substantially identical to a nut, adapter, and plunger pin of the manually actuated flush handle.

A sensor connected to the housing and a timing circuit inside the housing of the present invention, operates the motor upon sensing a use of the sanitary facility to which the housing is attached. The timing circuit also enables the sanitary unit to be flushed at predetermined intervals irrespective of use, where it may be desirable to add and remove anti-bacterial and cleaning agents to the sanitary facility at night when the unit is not being used.

In a preferred embodiment of the invention, the plunger pin is contacted by a post or hammer type mechanism which rotates through a small arc after the motor is furnished with a short pulse of electrical energy from the batteries. The tension device in the flush mechanism then returns the plunger pin and the post or hammer type mechanism to its original or non-flush position.

In another preferred embodiment of the invention, an internal passageway is provided within the automatic flush valve actuation device for communicating a fluid from an external reservoir to the sanitary facility. The fluid may be an antibacterial or cleaning agent and may be introduced to the sanitary facility by aspiration during flushing or by a drip method.

In another preferred embodiment of the invention, a cam device contacts the plunger pin, and the cam device rotates through 360 degrees after the motor receives a short pulse of electrical energy from the batteries. A switch and latching circuit then connects the electrical power to the motor, which continues the rotation of the cam. The cam surfaces are designed to initially actuate the plunger pin, then to allow the tension device of the plunger pin to move the plunger pin back to its non-flush position.

The present invention is adapted to be readily installed over existing manually operated flush handle mechanisms, without the need to shut off the water supply. The present device can be installed or removed in a matter of moments, using simple hand tools, and no external plumbing or electrical connections are required.

BRIEF DESCRIPTION OF THE DRAWINGS

FIG. 1 is a cut-away front elevational view of a flush valve mechanism assembly as commonly found in the prior art for manually flushing sanitary units such as toilets, urinals, and the like;

DESCRIPTION OF THE PREFERRED EMBODIMENT

Figure 1:
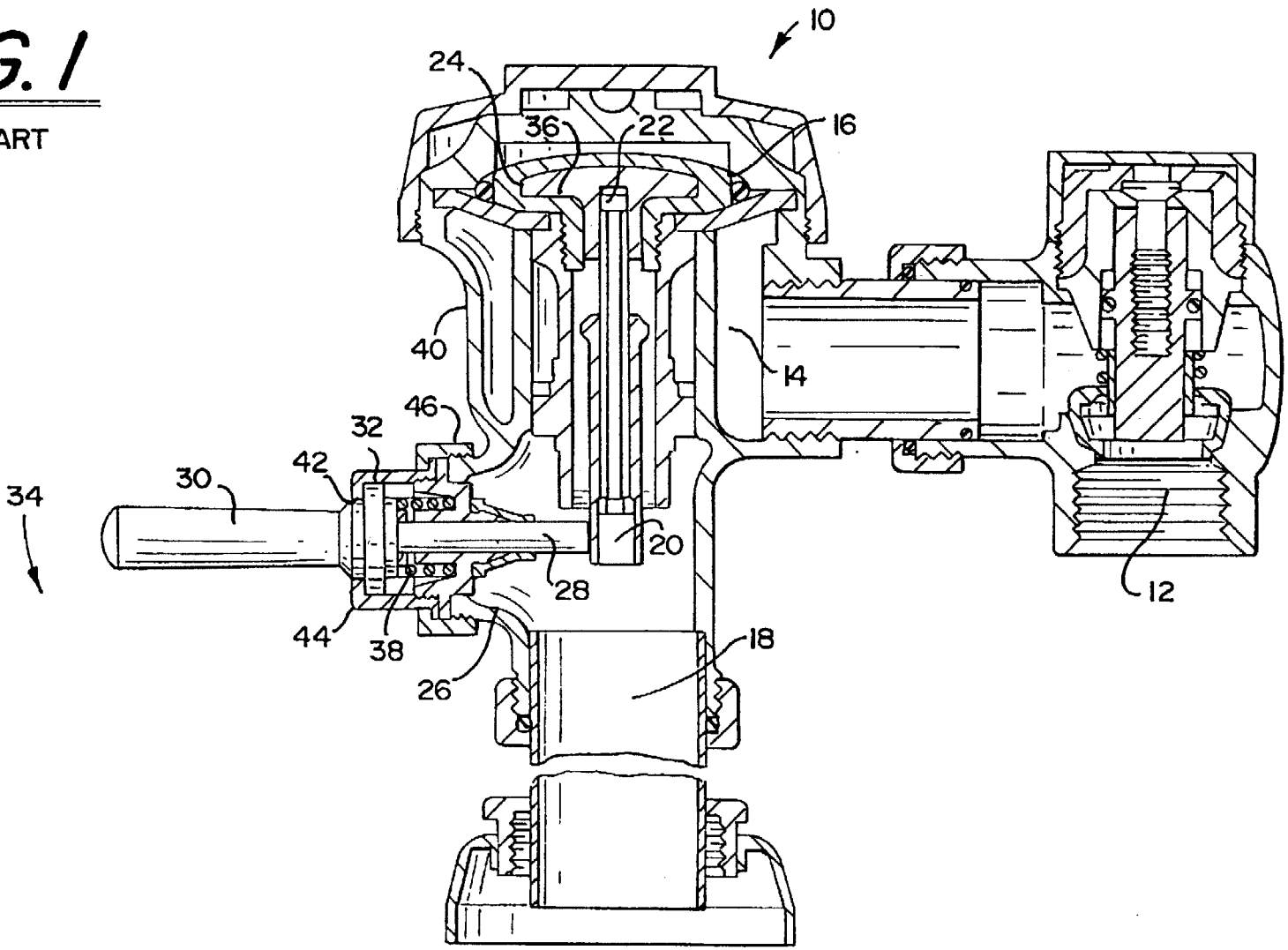
FIG. 1 PRIOR ART

Referring to FIG. 1, a flushing mechanism commonly found in the prior art for flushing sanitary units such as toilets and urinals is designated by the numeral 10. Flush water is supplied to the flushing mechanism 10 through an intake port 12, and the water is delivered to a chamber 14 normally closed off by a valve 16. Leading from valve 16 is a water delivery pipe 18 which leads directly to a sanitary unit, such as a toilet or urinal (not shown).

The valve 16 includes a stem 20 which extends downward in pipe 18. The upper portion 22 of stem 20 is connected to a tiltable valve operating mechanism 24. The lower portion 26 of stem 20 is adapted to be contacted by a moveable plunger pin 28, which is mechanically connected to a flush handle 30 through a partial ball joint linkage mechanism 32. When flush handle 30 is manually moved through the arc 34 from its first position, shown in FIG. 1, to a second downward position, plunger pin 28 moves to the right, contacts lower end 26 of stem 20, and tilts stem 20 to the right, as viewed in FIG. 1. This tilting movement of stem 20 causes valve 16 to pivot about point 36, thereby opening water delivery pipe 14 to the passage of flush water from chamber 14 and through pipe 18, thus flushing the sanitary unit.

A tension device, in the form of compression spring 38, is compressed when flush handle 30 is moved through arc 34. When manual pressure on handle 30 is released, spring 38 urges handle 30 back to the position shown in FIG. 1, thereby allowing stem 20 to return to its vertical position and close off valve 16. This halts the flushing operation through pipe 18.

Referring to FIG. 1, flushing mechanism 10 is encased in a housing 40 which has an opening 42 through which flush handle 30 extends. Opening 42 resides in a circular bushing 44 which is removably attached to housing 40 by a threaded nut 46. In most instances, nut 46 has a hexagonally shaped outer surface for engagement by an ordinary open-end wrench.

The plunger pin 28 is maintained in alignment with the stem 20 and flush handle via an adapter 39. The adapter 39 is, in turn, secured to the housing 40 through the interaction of circular bushing 44 and the threaded nut 46.

Figure 2:
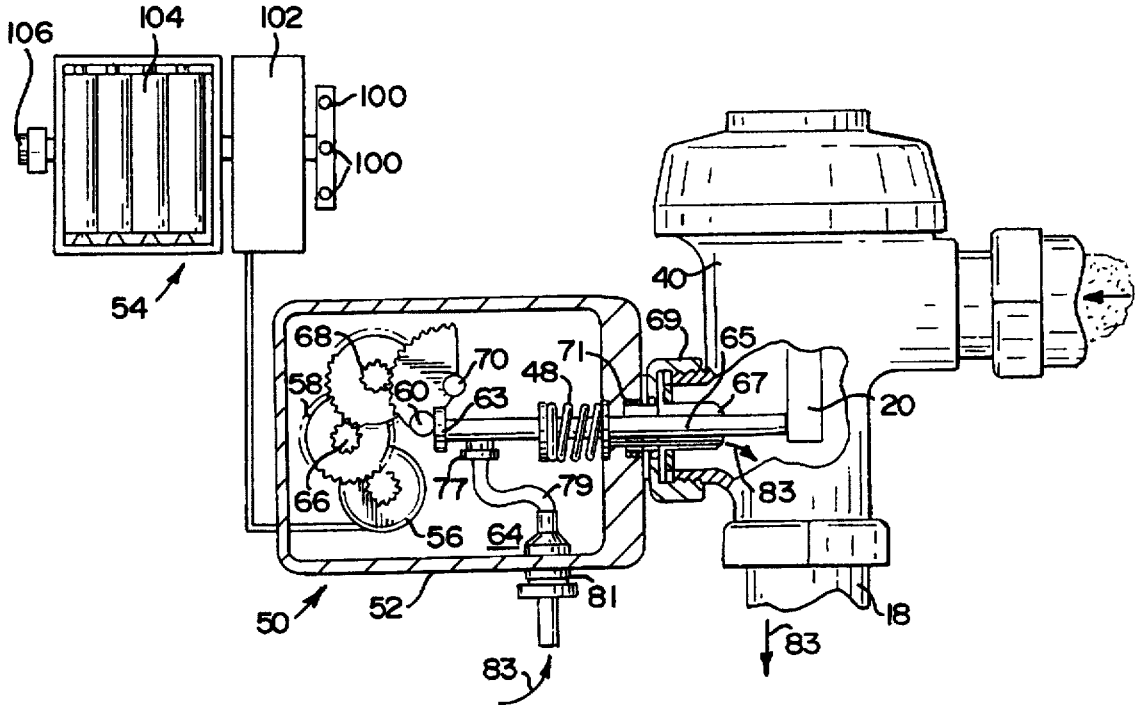
FIG. 2 is a schematic view of one embodiment of the automatic flush actuating mechanism of the present invention showing the power/circuit module, the actuating module, and the flush valve, with the plunger pin actuating mechanism in a deactuating position.
Figure 3:
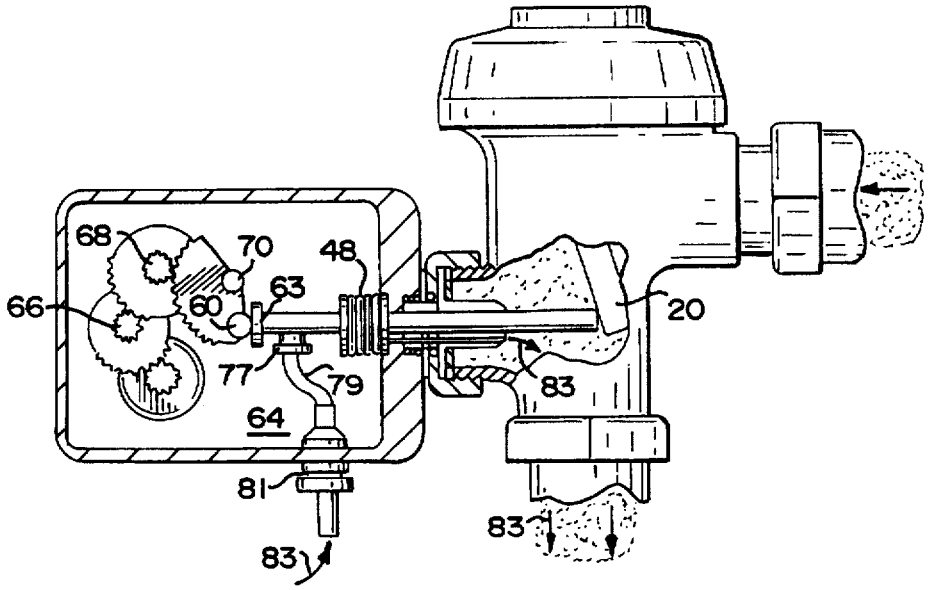
FIG. 3 is a schematic view of the flush handle actuating mechanism of FIG. 2, without the power/circuit module and showing the handle actuating mechanism in its actuation position.
Figure 4:
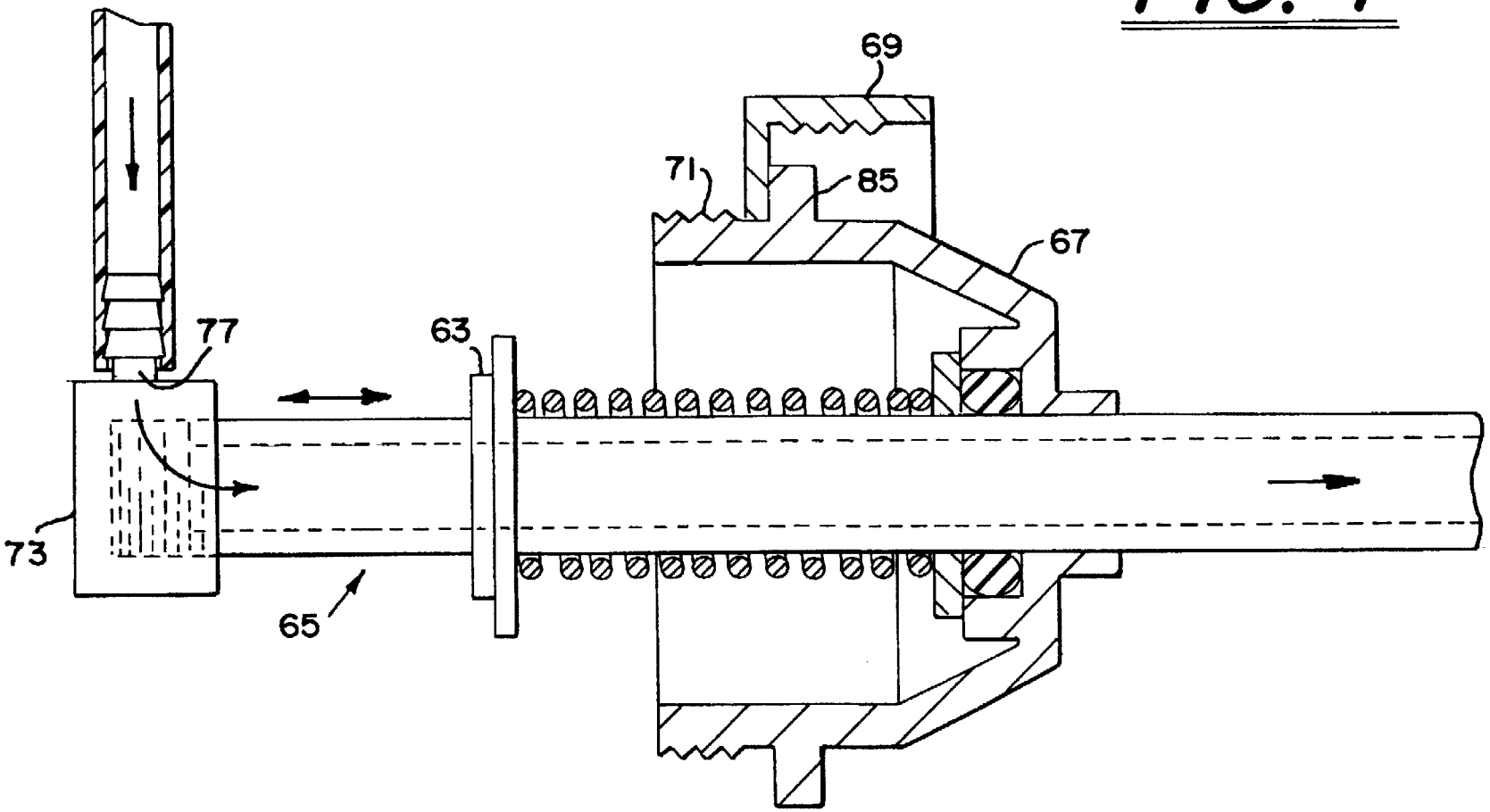
FIG. 4 is a cut-away view of a plunger pin and fluid passages of the automatic flush actuating mechanism in accordance with the invention.

One preferred embodiment of the automatic flush actuation device of the present invention is illustrated in FIGS. 2, 3 and 4, and is designated generally by the numeral 50. The flush handle actuation device 50 is comprised of two major components, i.e.: a first enclosure (modular housing unit 52) and a second enclosure (power/circuit module 54). The housing unit 52 is adapted to be easily mounted to flushing mechanism housing 40 in place of flush handle 30 in a manner to be explained. Internally of modular housing unit 52 is a motor 56 which is mechanically connected through a reduction gear train 58 to an actuating element (pin 60) which is mounted on gear 62 of reduction gear train 58. As motor 56 is activated, gear train 58 rotates gear 62 in a counterclock-wise direction, as viewed in FIG. 3. Pin 60 moves to the right, contacting face plate 63, and moving face plate 63 to the right to the position shown in FIG. 3. The movement of face plate 63 to the right also moves plunger pin 65 to the right, tilting stem 20 and activating flush mechanism 10. As will be explained in further detail, compression spring 48 (FIG. 2) returns face plate 63 and plunger pin 65 to the position shown in FIG. 2 after power to motor 56 is cut off.

Motor 56 is rigidly mounted to a side wall 64 of housing 52. Likewise, the elements of gear train 58 are rotatably mounted on shafts having axes 66, 68 and 70, which are rigidly mounted on side walls 64 of housing 52. Any reverse forces applied by spring 48 through face plate 63 during operation of motor 56 and movement of the plunger pin 65 from the position shown in FIG. 2 to the position of FIG. 3 is resisted by pin 60, gear train 58 and motor 56 acting through housing 52. For that reason, the present invention provides a rigid, while readily removable mounting structure between modular housing unit 52 and flushing mechanism housing 52.

To this end, referring to FIGS. 2, 3, and 4, modular housing unit 52 includes an adapter 67 secured to the housing 40 of the flush mechanism 10 via a threaded nut 69. The adapter 67 is rigidly secured to the housing unit 52 of the automatic flush mechanism 50 via a threaded hole 71 or other mounting device in the housing unit 52 and a complementary appendage 71 extending from the adapter 67. The threaded nut 69 surrounds the adapter 67 and is captured on the adapter by the housing 52 on one end of the adapter 67 and a hub 85 (FIG. 4) on a second end of the adapter 67.

Alignment of the plunger pin 65 with the stem 20 of the flush mechanism 10 is maintained by the adapter 67 in a similar manner to that used in the prior art (FIG. 1). The plunger pin 65, on the other hand, has been modified in accordance with an embodiment of the intention for use with the automatic flush activation device 50 and to accommodate the introduction of chemical freshening agents (e.g., disinfectants and cleaning solvents) into the sanitary facility served by the flush mechanism 10.

The details of the modifications of the plunger pin 65 may be best understood by reference to FIG. 4. As shown in FIG. 4, an annular member (spring stop 73) is located midway along a longitudinal direction of the plunger pin 65. An internal longitudinal passageway 75 has been created within the plunger pin 65 (e.g., by drilling) for the communication of fluids between an external tubing connector 77 and a discharge pipe 18 of the flushing mechanism 10.

The spring stop 73 acts to engage and compress the spring 48 (see FIG. 3) following activation of the automatic flush mechanism 50. After deactivation of the motor 56 of the automatic flush mechanism 50, the spring 48, acting through the spring stop 73 and the face plate 63, brings the pin 60 back to a starting position (FIG. 2).

To introduce disinfectants and cleaning fluids to the sanitary fixture via the automatic flush activation device 50, a short flexible tube 79 (FIG. 2) interconnects the external tubing connector 77 and a second connector 81. The second connector 81, in turn, may be connected to a fluid reservoir (not shown) by tubing or otherwise. Introduction of fluid into the discharge pipe 18 may be accomplished intermittently by aspiration during a flush cycle or continuously through use of a metering valve. Fluid flow is shown diagrammatically in FIGS. 2 and 3 by arrows 83.

Alternatively fluid flow may be controlled by a fluid pump (not shown) associated with the fluid reservoir. Activation of the fluid pump may be accomplished by interconnecting the fluid pump in parallel with the motor M 56 or electronically by a fluid pump activation signal derived from the application of an activating voltage to the motor 56.

Figure 5:
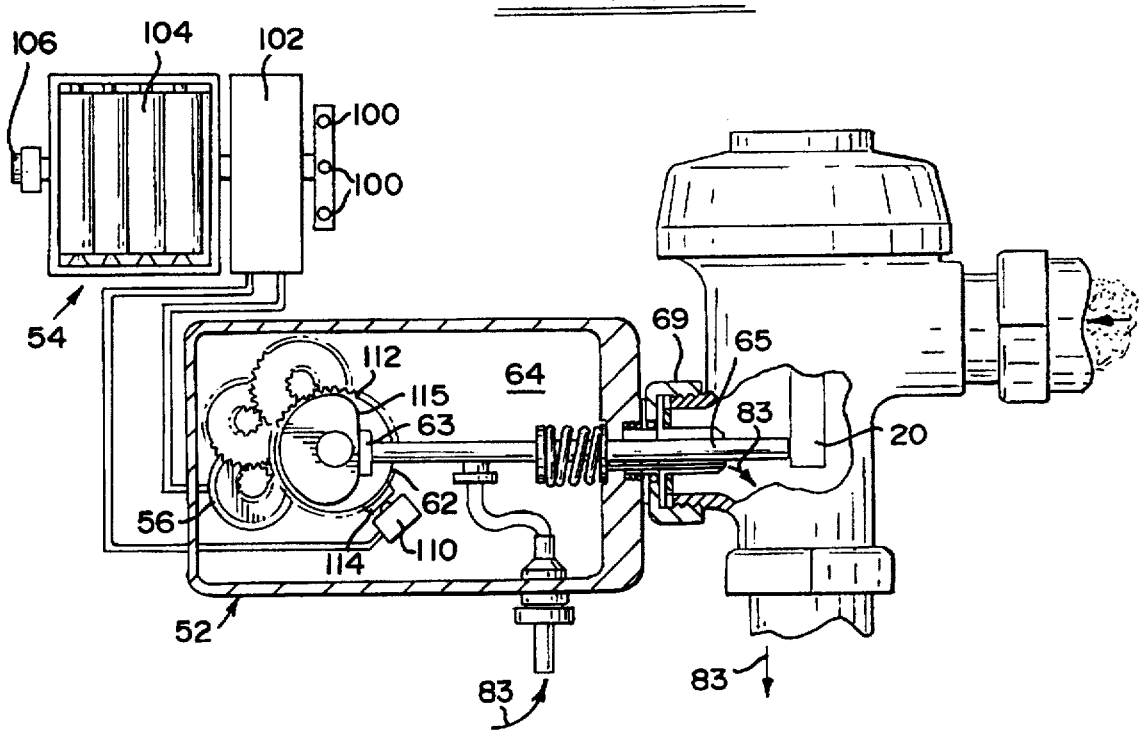
FIG. 5 is a schematic view of another embodiment of the automatic flush handle actuating mechanism of the present invention showing the power/circuit module, the actuating module and the flush valve, with the plunger pin actuating mechanism in a de-actuating position.

In another embodiment of the invention, the pin 60 (FIGS. 2 and 3) is replaced by a cam 112 (FIGS. 5 and 6), rigidly mounted to the gear 62 of reduction gear train 58. Under this embodiment, the cam 112 and the gear 62 rotate through one complete revolution for each flush cycle. Following activation of the automatic flush activation device 50, the cam 112 moves from a quiescent state (FIG. 5) to a flushing state (FIG. 6) and then back to the quiescent state (FIG. 5). As the cam 112 moves from the quiescent state (FIG. 5) to the flushing state (FIG. 6), the cam 112 engages and moves the plunger pin 65 to the right, thereby activating the flush mechanism 10.

A limit switch 110 and limit switch activation device 114 under this embodiment, are provided to sense the quiescent position of the cam 112. Following activation, the limit switch 110 latches the motor 56 into a run state until the limit switch 110 is again activated by the limit switch activation device 114.

Operation of the automatic flush actuation device 50 of FIGS. 2 and 3 or FIGS. 5 and 6 occurs under any of a number of predetermined events. One such event is use of the sanitary unit. Another event may be non-use of the sanitary unit for some predetermined time period. Upon the occurrence of one of the predetermined events, a signal generating means activates the automatic flush actuation device 50.

Referring to FIG. 2, one signal generating means includes a sensor for detecting use of the sanitary facility. The sensor may be a motion detector 100, infra-red sensor, or a body heat detector. Upon detection of use by the sensor, an electronic control means (circuit board 102) inter-connected between a power source 104 and drive mechanism 50 within the modular housing unit 52 provides a pulse of electrical energy to the motor 56 of such duration as to rotate the gear 62 through a predetermined arc, at which point the motor stalls. At the end of this arc, power to motor 56 is cut off, and spring 48 moves the plunger pin 65 back to its closed position. Pressure on pin 60 causes gear 62 to rotate clockwise from the position shown in FIG. 3 to the position shown in FIG. 2. In the preferred embodiment, power source 104 constitutes one or more battery units (four shown), whereby no outside electrical power is required to operate motor 56.

Other signal generating means include a user button 106 or an interval timer on circuit board 102 set to activate the automatic flush actuation device 50 during the evening hours when use of the sanitary unit would be infrequent.

Figure 7:
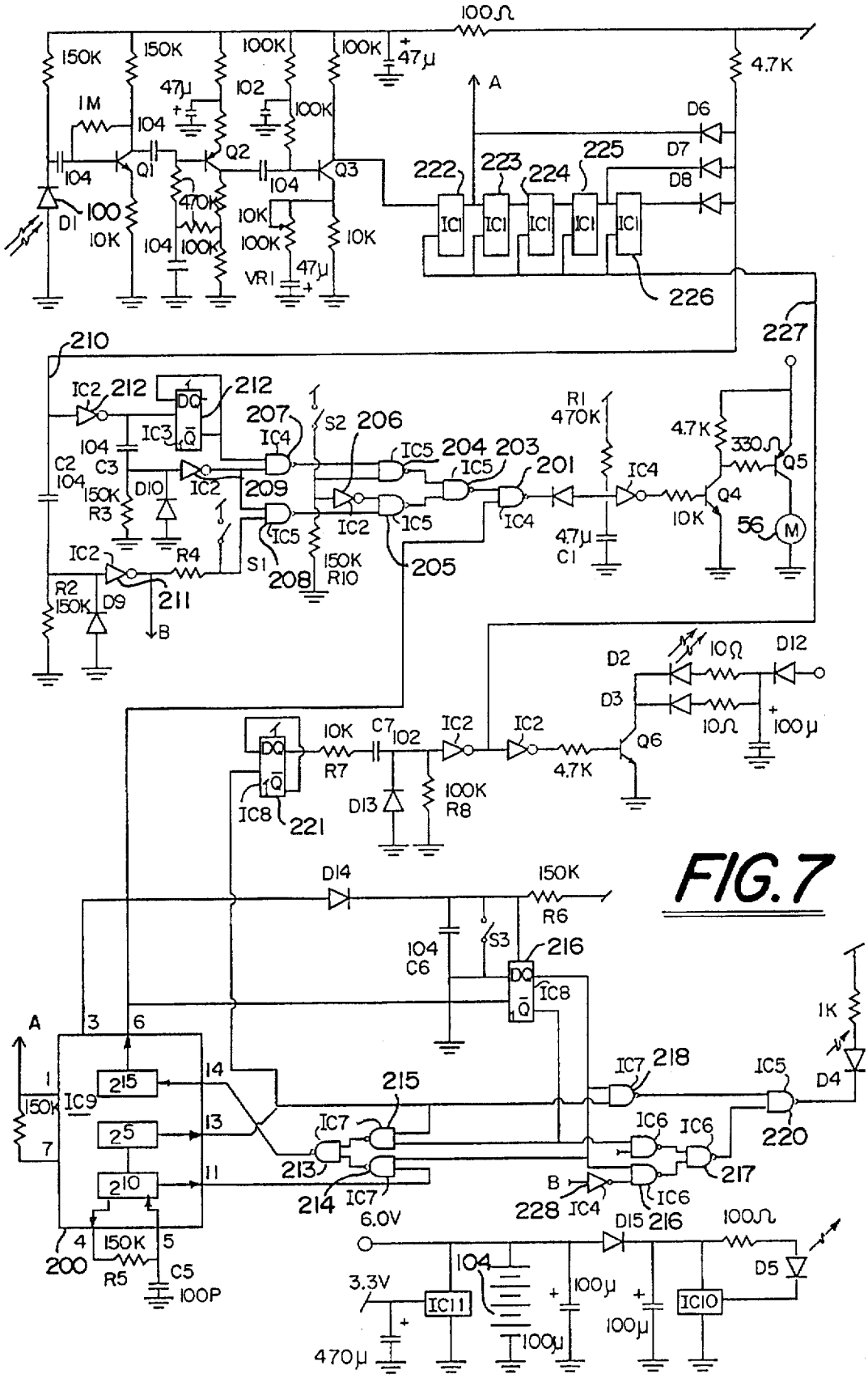
FIG. 7 is a circuit diagram of the power/circuit module of the present invention.

Control of the automatic flush activation device 50 under an embodiment of the invention can be best understood by reference to the circuit diagram of FIG. 7 and by reference to the parts list of TABLE 1:

TABLE 1

| | |
|---|---|
| IC1: | PC74HC74, CMOS, PHILIPS OR EQUIVALENT |
| IC2: | N74HC04, CMOS, MITSUBISHI OR EQUIVALENT |
| IC3.8: | PC74HC74, CMOS, PHILIPS OR EQUIVALENT |
| IC4: | HD74HC02, CMOS, HITACHI OR EQUIVALENT |
| IC5,6,7: | HD4HC00, CMOS, HITACHI OR EQUIVALENT |
| IC9: | BJ-101, CMOS ASIC, HOLTEK MICRO ELECTRONICS |
| IC10: | 7044A, 4.4 V VOLTAGE DETECTOR, HOLTEK MICRO ELECTRONICS |
| IC11: | 1033, 3.3 V VOLTAGE DETECTOR, HOLTEK MICRO ELECTRONICS |
| DI: | INFRARED PHOTO DIODE |
| D2,3: | INFRARED EMITTING DIODE, 5 MM DIAMETER |
| D4: | RED LED, 5 MM DIAMETER |
| D5: | GREEN LED, 5 MM DIAMETER |
| D6–15: | IN4I4148 SWITCHING DIODE |
| Q1,3,4: | 2SC945 NPN TRANSISTOR OR EQUIVALENT |
| Q2: | 2SA733 PNP TRANSISTOR OR EQUIVALENT |
| Q5: | 2SB562 PNP TRANSISTOR OR EQUIVALENT |
| Q6: | 2SD965 NPN TRANSISTOR OR EQUIVALENT |

Activation of the motor 56 of FIG. 7 under a preferred embodiment occurs upon receipt of an activation signal from either of two possible signal sources: (1) an output from a motion sensing detector 100 indicating use of the sanitary facility; or (2) an output of a timer 200. An output from either source results in an activating signal to the motor 56 through a controlling "NOR" gate 201.

For the motor 56 to remain in a deactivated state, the controlling NOR gate 201 must have a logical 0 on each input. A logical 0 at both inputs of NOR gate 201 results in a logical 1 at the output of the NOR gate 201 and a 0 at the output of the inverter 202. A 0 at the output of the inverter 202 causes transistors Q4 and Q5 to remain in a non-conductive state resulting in no voltage being applied to the motor 56.

A logical 0 at both inputs of the NOR gate 201 causes a capacitor C1 of a resistor-capacitor (RC) timing circuit, R1 and C1, to charge to a supply voltage value (3.3 V). The momentary application of a positive-going pulse to either input of the NOR gate 201 causes the capacitor C1 of the RC timing circuit to rapidly discharge to 0 through NOR gate 201. A logical 0 at capacitor C1 and at the input to the inverter 202 causes the activation of the motor 56 through transistors Q4 and Q5. The time of activation of the motor 56 is determined by the charging time of the RC timing circuit R1, C1 after the input of the NOR gate 201 has returned to 0.

The occasion for the generation of the positive-going pulse at the input of the NOR gate 201 from the sensor 100 is determined by the state of mode switches S1 and S2. When the mode switches S1, S2 are in the state shown in FIG. 7 (sanitary mode), the motor 56 will be activated both when a user approaches the sanitary facility and when the user leaves the sanitary facility. When only switch S1 is closed (normal mode) the motor 56 will be activated only once for each use of the sanitary facility. When only switch S2 is closed, the motor 56 will only be activated after every other use of the sanitary facility.

With switches S1 and S2 in the sanitary mode (S1 and S2 as shown in FIG. 7), a logical 0 is applied to one input of NAND gate 204 due to the open state of the switch S2 and because resistor R10 pulls the input to a very low value. The 0 at one input of the NAND gate 204 blocks the passage of any control signals from the sensor 100 through the NAND gate 204. Conversely, the logical 0 from switch S2 causes a logical 1 on NAND gate 205 though inverter 206. The logical 1 on one input of NAND gate 205 allows the passage of control signals from the sensor 100 to the controlling NOR gate 201 through NAND gates 203,205 and 208.

With the sensor 100 in a deactivated state, a logical 0 is maintained on interconnect 210. The logical 0 on interconnect 210 results (after a time period) in logical 0's on the inputs of inverters 209 and 211 as well. The logical 0's on the inputs of inverters 209 and 211 causes logical 1's to be applied to the inputs of NAND gate 208 and, consequently, a logical 0 at the input of the controlling NOR gate 201.

Upon the activation of the sensor 100, caused by the approach of a user to the sanitary facility, the interconnect 210 rises to a logical 1. The change of interconnect 210 to a logical 1 causes a negative-going pulse to emanate from the output of inverter 211. The negative-going pulse is transferred to the controlling NOR gate 201 causing activation of the motor 56 through NAND gates 208, 205 and 203. The duration of the negative-going pulse from inverter 211 is determined by resistance and capacitance values of a second RC timing circuit R2, C2.

Likewise, when the user of the sanitary facility leaves (causing deactivation of the sensor 100), a second negative-going pulse emanates from the output of inverter 209. The duration of the second negative-going pulse is determined by resistance and capacitance values of the third RC timing circuit R3, C3.

When the switches S1, S2 of the automatic flush handle activation device 50 are changed to the normal mode (S1 closed; S2 open), the first negative-going pulse is dissipated across resister R4 into the power supply (3.3 V) through switch S1. Placing the automatic flush valve activation device 50 in the normal mode causes the motor 56 to be activated only once for each use of the sanitary facility (when the user walks away thereby causing the sensor 100 to become deactivated) by a negative-going pulse from inverter 209 through NAND gates 208, 205, 203.

When the automatic flush handle activation device 50 is placed in the water saver mode (S2 closed), the motor 56 is activated (sanitary facility flushed) only after every other use of the sanitary facility. Activation of the motor 56 after every other use is accomplished by rerouting the activation signal from a path through NAND gates 208, 205 and 203 to a path through NOR gate 207 and NAND gates 204 and 203. Rerouting is accomplished by placing a logical 1 on one input of NAND gate 204 through switch 52 and by placing a logical 0 on NAND gate 205 through use of switch 52 and inverter 206. The application of a logical 0 on one input of NAND gate 205 blocks signal flow through NAND gate 205. The application of a logical 1 to one input of NAND gate 204 allows signal flow through NAND gates 204 and 203 from NOR gate 207.

NOR gate 207 provides a logical 1 output only when both input signals become a logical 0. Inverter 209, as explained above, provides a negative-going pulse each time the sensor transcends to a deactivated state. D flip-flop 212, on the other hand, toggles between a set and a reset state each time the sensor 100 is activated. Each time the flip-lip 212 is in a reset state when the sensor 100 is activated, the output of the flip-flop 212 (logical 1) blocks (at NOR gate 207) the negative-going pulse from inverter 212. The net result of blocking every other pulse is that whenever the switch S2 is closed, the motor 56 is activated (sanitary facility flushed) only once for each two uses of the sanitary facility.

Turning now to the timing circuit 200, an output activating the motor 56 is provided at the controlling NOR gate 201 from the timing circuit 200 every four hours. The output is provided by dividing a 75 kilo Hertz (kHz) signal within $2^{10}$, $2^5$ and $2^{15}$ counters. The 75 kHz signal is generated by an oscillator consisting of the $2^{10}$ counter and a resistance-capacitance network R5, C5. The 75 kHz signal is reduced in frequency within the $2^{10}$ and $2^5$ counters of timer circuit 200 and routed through NAND gates 215 and 213 before being reduced to a four hour signal within the $2^{15}$ counter of the timer circuit 200.

Upon insertion of batteries into the power unit 104 of the automatic flush handle activation device 50, a D flip-flop 216 is placed into a set state by the interaction of a capacitor C6 and a resister R6. Placing the D flip-flop 215 into a set state provides a calibration interval (7.5 minutes) for adjustments to a variable resister, VR1, controlling the sensitivity of the sensor 100. During normal operation, adjustments may be made to the sensitivity of the sensor 100 by pushing a calibration button S3.

During the calibration interval, a Logical 0 on the $\overline{Q}$ output of the D flip-flop 216 blocks signals passing from the $2^5$ counter to the $2^{15}$ counter at NAND gate 215. A logical 1 on the Q output of the D flip-flop 216 allows a signal to pass directly from the $2^{10}$ counter to the $2^{15}$ counter via NAND gates 214 and 213. An output of the $2^{15}$ counter is then applied to a toggle input resetting D flip-flop 216 after 7.5 minutes.

To aid in the calibration of the sensor 100 during the calibration interval, a light emitting diode (LED) D4 provides visual indication that a user is within range of the sensor 100. A negative-going pulse, B, caused by activation of the sensor 100 is gated during the calibration interval by the Q output of the D flip-flop 216 to the LED D4 via inverter 228 and NAND gates 216, 217 and 220. After the calibration interval, a second output, A, providing visual indication from the sensor 100 is gated to the LED D4 by the $\overline{Q}$ output of the D flip-flop 216 via NAND gates 219, 217 and 220.

Operation of the sensor 100 is facilitated through use of two infrared transmitters D2, D3. A 2.27 Hz signal from an output of the $2^5$ counter of the timing circuit 200 is divided in half within a D flip-flop 221 and is shaped within an RC network, R7, C7 before application to transmitting diodes D2, D3 via transistor Q6.

When a user approaches the sanitary facility, infrared light from the transmitting diodes D2, D3, reflected from the user is detected by the sensor 100 and amplified by transistors Q1–Q3. The amplified signal is then shifted across shift registers 221–226 by the 1.15 Hz signal 227 also applied to the transmitting diodes D2, D3. Output signals from the sensor 100 are expanded and delayed within the shaft register 221–226 before application to the interconnect 210 via diodes D6–D8.

Figure 8:
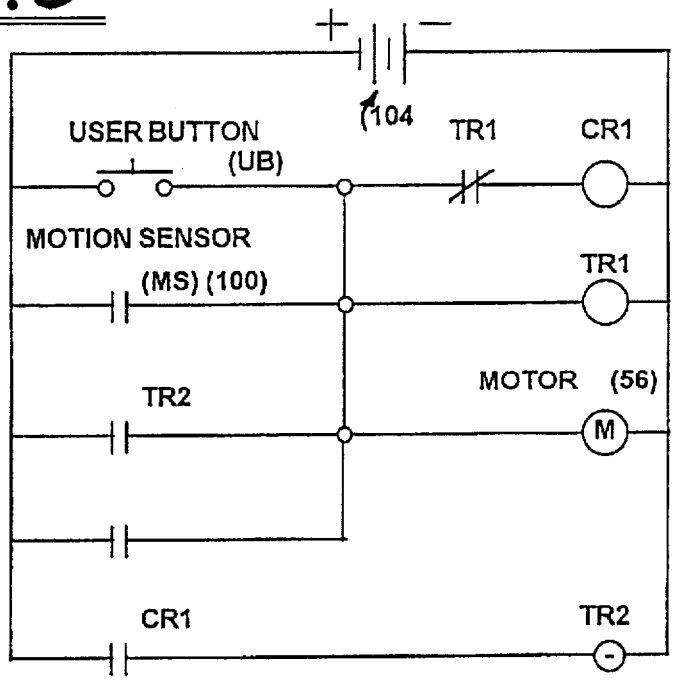
FIG. 8 is an alternate circuit diagram of the power/circuit module of FIGS. 2 and 3 under an embodiment of the present invention.

Control of the automatic flush handle activator device 50 under an alternate embodiment (FIG. 5) may be understood by reference to the circuit diagram of FIG. 8. The motor 56 of the modular housing unit 52 as described above may be activated by any one of three possible events: (1) activation by a user of the user button 106; (2) activation of a motion sensor 100; or (3) expiration of a time interval programmed into the interval timer TR2 (FIG. 8). The interval timer may be used during extended periods of inactivity (e.g. every two hours) to activate the flushing mechanism 50. After each event, a normally-closed contact CR1 would reset the timer TR2 for activation after another interval.

Following activation of the motor 56 by a signal generating means, a bridging contact CR1 is closed across the signal generating means electric contact (FIG. 8) to maintain power on the motor 56 for sufficient time for the gear 62 of the reduction gear train 58 to rotate through its predetermined arc. Cycle timer TR1 is programmed to allow sufficient time for such rotation before deactivating the motor 56. Rotation of the gear 62 through the predetermined arc allows the pin 60, attached to the gear 62, to move the plunger pin 65 from a first position (FIG. 2) to the second position (FIG. 3). As the plunger pin 65 moves to the second position (FIG. 3), the cycle timer TR1 times out, deactivating the motor 56, and allows the spring 48 within the flushing mechanism 10 to return the plunger pin 65 to the first position (FIG. 2) as described above, since motor 56 is deactivated.

In another embodiment of the invention (FIGS. 5 and 6), a position sensor 110 (e.g., a limit switch or proximity detector) is used to determine a rotational position of the gear 62. In addition, an actuating element consisting of a cam 112 is rigidly attached to the gear 62 on shaft axis 70.

When motor 56 is activated, gear 62 and cam 112 rotate in a counter-clockwise direction. The surface 115 (FIG. 5) of cam 112 is designed such that partial rotation of the cam will move plunger pin 65 from the position shown in FIG. 5 to the position shown in FIG. 6, thereby flushing the sanitary unit to which the flushing mechanism 10 is attached. As cam 112 continues to rotate counter-clockwise, plunger pin 65 comes into contact with flat surface 115 of cam 112, and the flush handle moves back to the position shown in FIG. 4 under the influence of spring 48. Cam 112 and gear 62 continue to rotate until they reach the position shown in FIG. 5, when rotation is halted by the control elements provided in circuit board 102, which also sets the operating components for the next flushing operation.

Rotational positioning of the gear 62 and cam 112 is provided by a sensor activating element 114 rigidly mounted to the periphery of the gear 62. When the gear 62 is in the first position (FIG. 5) the position sensor 110 is activated by the sensor activating element 114. When the gear 62 rotates out of the first position the position sensor 110 becomes deactivated until the gear 62 (and sensor activating element 114) again returns to the first position.

Figure 6:
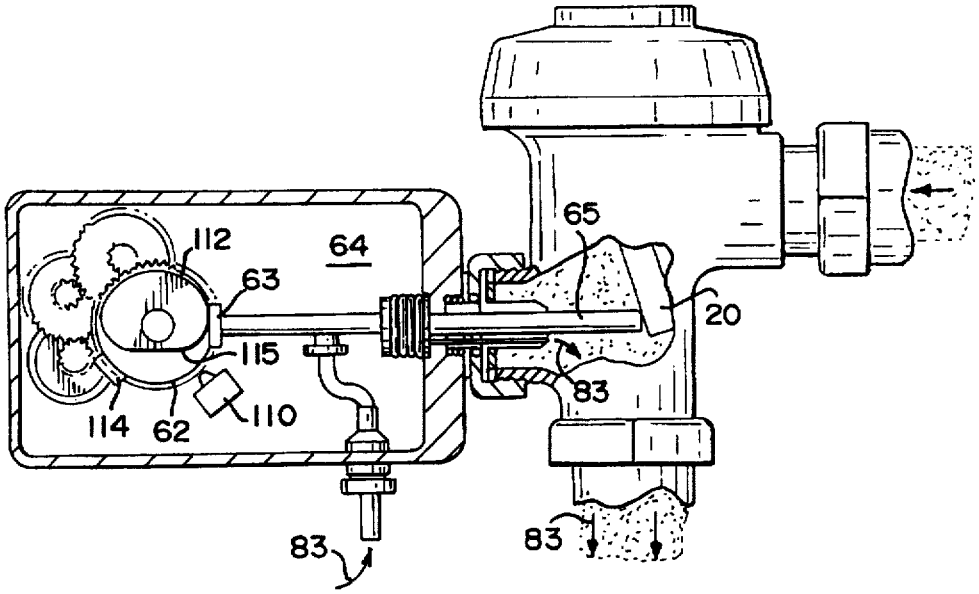
FIG. 6 is a schematic view of the flush handle actuating mechanism of FIG. 5, without the power/circuit module, and showing the handle actuating mechanism in its actuation position.
Figure 9:
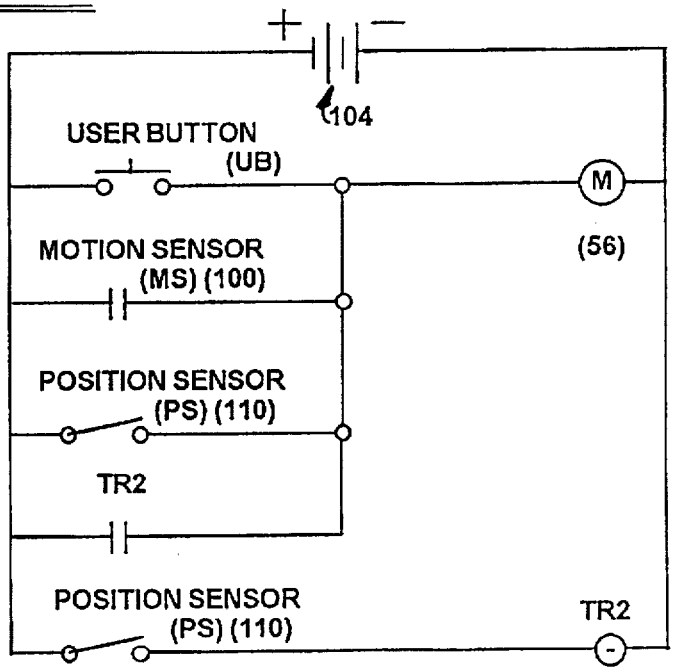
FIG. 9 is a circuit diagram of the power/circuit module of FIGS. 5 and 6 under an embodiment of the present diagram.

FIG. 9 is an alternate embodiment circuit diagram of the power/circuit module 54 of the embodiment of FIGS. 5 and 6. The 2 contacts of the position sensor 110 (normally-open and normally-closed) of FIG. 9 are shown in the deactivated state (sensor activating element 114 not activating the position sensor 110).

As shown in FIG. 9, whenever the position sensor 110 is deactivated by movement of sensor activating element 114 away from the position sensor 110, the motor 56 will continue to rotate until the sensor activating element 114 again engages the position sensor 110. Events that will cause the position sensor 110 to become deactivated include: (1) activation of the user button 106; (2) activation of the motion sensor 100; or (3) time-out of the timer TR2. Upon deactivation of the position sensor 110 because of any of the three events, the gear 62 and cam 112 will rotate through one complete revolution. Where deactivation of the position sensor 110 is caused by time-out of the timer TR2, the rotation of the cam 112 will also reset the timer TR2 through operation of the normally open set of position sensor 110 contacts.

Installation of automatic flush activation device 50 may be easily accomplished without turning off water pressure to the flush mechanism 10. Ease of installation is facilitated because the automatic flush activation device 50 is installed in a pipe 18 that is not pressurized until a flushing cycle is initiated.

A prior art flush mechanism 10 (FIG. 1) may be prepared for installation in the automatic flush device 10 by removal of the threaded nut 46 with a wrench (not shown). Following removal of the threaded nut 46, the flush handle 30, circular bushing 44, spring 38, plunger pin 28, and adapter 39 may be easily removed without further use of tools. The housing unit 52 may be installed by inserting the plunger pin 65 and adapter 67 into the housing 40 and secured with the threaded nut 69.

Figure 10:
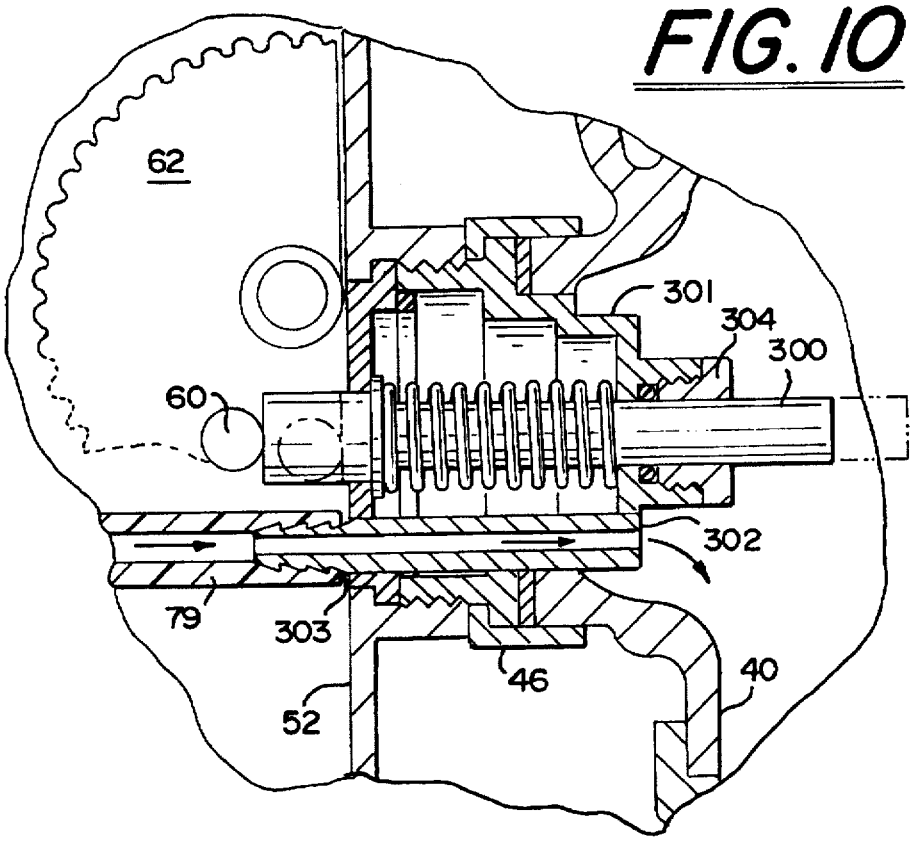
FIG. 10 is a cut-away view of a plunger pin and adapter under an alternate embodiment of the invention.
Figure 11:
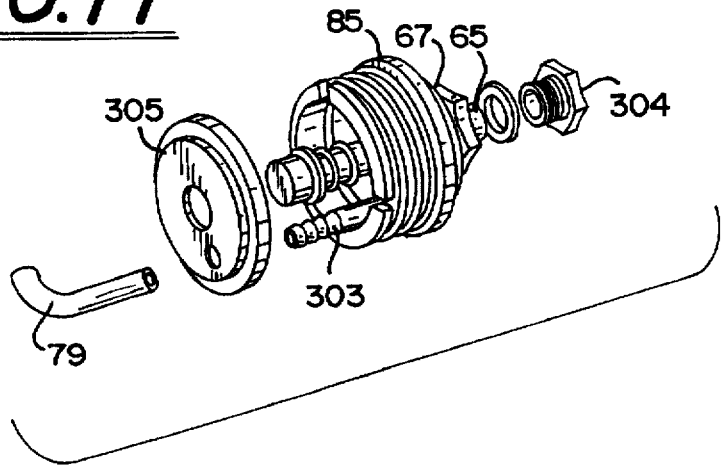
FIG. 11 is an exploded view of the adapter of FIG. 11 in accordance with the invention.

In an alternate embodiment of the invention the adapter 67 and plunger pin 65 of FIG. 4 are replaced with an adapter 301 (FIG. 10) containing an integral passageway 302 and a solid plunger pin 300. The internal passageway is created by forming a hole 302 parallel to the solid plunger pin 300 through the adapter 301 along the periphery of the adapter. A short section of metal tubing 303 (FIG. 11) may then be threaded into the hole 302 and interconnected with the fluid reservoir through interconnect tubing 79.

The mechanical stability of the tubing 303 and a first end of the solid plunger pin 300 is enhanced through the use of a hose cap 305 inserted between the adapter 305 and housing 52. The stability of the solid plunger pin 300 at a second end is enhanced through the use of cap 304 having a through-hole for passage of the solid plunger pin 300. This structure could be molded in.

As demonstrated, the automatic flush handle activation device of the invention provides an easy-to-install, reliable means of flushing sanitary devices without direct user intervention. Such means is provided without the help of a skilled craftsman or outside power sources. The use of a screw-on coupling member allows the automatic flush handle activation device to be attached to existing plumbing fixtures without concern for service interruptions or damage to the existing plumbing fixtures due to twisting forces inherent in prior art devices. Also, the screw-on coupling member allows the flush activation device of the present invention to be easily removed and replaced, if necessary.

The foregoing specification describes only the preferred embodiments of the invention as shown. Other embodiments besides the ones described above may be articulated as well. The terms and expressions, therefore, serve only to describe the invention by example only and not to limit the invention. It is expected that others will perceive differences which, while differing from the foregoing, do not depart from the spirit and scope of the invention herein described and claimed.

What is claimed is:

1. An automatic flush valve actuation apparatus for replacing a manually activated flush handle of a flush mechanism of a sanitary facility, such apparatus comprising: an enclosure containing a drive mechanism; a self-contained power source for the drive mechanism; means for sensing use of the sanitary facility; means for interconnecting the drive mechanism and the power source when the means for sensing detects a use of the sanitary facility; an adapter having first and second ends rigidly engaging the enclosure at the first end; a plunger pin having first and second ends slidably extending through the adapter, engaging the drive mechanism within the enclosure at a first end; and a threaded nut encircling the adapter and captured on the adapter by the enclosure at the first end of the adapter and by a hub at the second end of the adapter, the threaded nut, second end of the adapter and second end of the plunger pin being constructed to operably interact with the flush mechanism in a manner substantially identical to a nut, adapter, and plunger pin of the manually actuated flush handle.

2. The apparatus as in claim 1 further comprising means for deactivating the means for interconnecting after a flush interval.

3. The apparatus as in claim 1 wherein the means for sensing further comprises an infrared sensor.

4. The apparatus as in claim 1 wherein the self-contained power source further comprises a battery.

5. The apparatus as in claim 1 wherein the self-contained power source and means for sensing are located within a second enclosure operably interconnected with the enclosure containing the drive means.

6. The apparatus as in claim 1, wherein the self-contained power source and means for sensing are located within the enclosure containing the drive means.

7. The apparatus as in claim 1 further comprising means for introducing a fluid into the sanitary facility.

8. The apparatus as in claim 7 wherein the fluid further comprises one of a bacteriostat and a cleaning agent.

9. The apparatus as in claim 1 wherein the means for inter-connecting further comprises logic means for interconnecting the drive mechanism and self-contained power source when the means for sensing detects the approach of a user and the withdrawal of a user from the sanitary facility.

10. The apparatus as in claim 1 wherein the means for inter-connecting further comprises logic means for interconnecting the drive mechanism and self-contained power source only when the means for sensing detects a withdrawal of a user from the sanitary facility.

11. The apparatus as in claim 1 wherein the means for inter-connecting further comprises logic means for interconnecting the drive mechanism and self-contained power source only after detection of every other use of the sanitary facility by the means for sensing.

12. The apparatus as in claim 1 wherein the drive mechanism further comprises an electric motor and gear train.

13. An automatic flush valve actuation apparatus for a flushing mechanism of a sanitary facility comprising: an enclosure rigidly attached to the flushing mechanism containing a drive mechanism; a plunger pin having first and second ends slidably disposed within the enclosure and flushing mechanism operably engaging the drive mechanism at a first end and a stem of a valve of the flushing mechanism at a second end; and means disposed within the enclosure for communicating a chemical freshening agent between an external reservoir and stem of the valve of the flushing mechanism.

14. The apparatus as in claim 13 further comprising means for sensing use of the sanitary facility.

15. The apparatus as in claim 14 further comprising a self-contained power source for the drive mechanism.

16. The apparatus as in claim 15 further comprising means for interconnecting the power source and drive mechanism when the means for sensing detects use of the sanitary facility.

17. The apparatus as in claim 16 wherein the means for interconnecting further comprises logic means for interconnecting the drive mechanism and self-contained power source when the means for sensing detects the approach of a user and the withdrawal of a user from the sanitary facility.

18. The apparatus as in claim 16 wherein the means for interconnecting further comprises logic means for interconnecting the drive mechanism and self-contained power source only when the means for sensing detects a withdrawal of a user from the sanitary facility.

19. The apparatus as in claim 16 wherein the means for inter-connecting further comprises logic means for interconnecting the drive mechanism and self-contained power source only after detection of every second use of the sanitary facility by the means for sensing.

20. The apparatus as in claim 13 wherein the drive mechanism further comprises an electric motor and gear train.

21. The apparatus as in claim 13 wherein the means for communicating a fluid between an external reservoir and stem of the value of the flushing mechanism further comprises a longitudinal passageway within the plunger pin between the second end of the plunger pin and an external fitting proximate the first end of the plunger pin.

22. The apparatus as in claim 21 wherein the means for communicating a fluid between an external reservoir and stem of the value of the flushing mechanism further comprises tubing between the external fitting and the reservoir.

23. The apparatus as in claim 13 wherein the fluid further comprises one of a bacteriostat and a cleaning agent.

24. The apparatus is in claim 13 further comprising a fluid pump for urging the fluid from the external reservoir to the stem of the valve.

25. The apparatus is in claim 24 further comprising means for activating the fluid pump in conjunction with activation of the automatic flush valve activation apparatus.

26. The apparatus as in claim 1 wherein the means for interconnecting further comprises logic means for interconnecting the drive mechanism and self-contained power source after a predetermined interval of non-use of the sanitary facility.

27. The apparatus as in claim 1 wherein the means for interconnecting further comprises logic means for interconnecting the drive mechanism and self-contained power source upon activation of a manual user button.

* * * * *